US008844472B2

(12) United States Patent
Smelcer et al.

(10) Patent No.: US 8,844,472 B2
(45) Date of Patent: Sep. 30, 2014

(54) FIRE TUBE HEATER

(75) Inventors: Jim C. Smelcer, Hermitage, TN (US); Brian J. Iske, Murfreesboro, TN (US); Neil W. Rolph, Lebanon, TN (US)

(73) Assignee: Lochinvar, LLC, Lebanon, TN (US)

( * ) Notice: Subject to any disclaimer, the term of this patent is extended or adjusted under 35 U.S.C. 154(b) by 1267 days.

(21) Appl. No.: 12/644,164

(22) Filed: Dec. 22, 2009

(65) Prior Publication Data

US 2011/0146594 A1 Jun. 23, 2011

(51) Int. Cl.
*F24H 1/20* (2006.01)

(52) U.S. Cl.
USPC ..... 122/18.3; 122/44.1; 165/173

(58) Field of Classification Search
USPC ..... 122/18.3, 44.1
See application file for complete search history.

(56) References Cited

U.S. PATENT DOCUMENTS

| | | | |
|---|---|---|---|
| 108,050 | A | 10/1870 | Raisbeck et al. |
| D14,883 | S | 3/1884 | Arci et al. |
| 469,731 | A | 3/1892 | Althouse |
| 514,338 | A | 2/1894 | Row |
| 601,590 | A | 3/1898 | Rossman |
| 629,245 | A | 7/1899 | Frank |
| 691,978 | A | 1/1902 | Smith et al. |
| 770,599 | A | 9/1904 | Monteagle |
| 811,016 | A | 1/1906 | Whyte et al. |
| 910,192 | A | 1/1909 | Grouvelle et al. |
| 951,215 | A | 3/1910 | Millan |
| 1,391,871 | A | 9/1921 | Volk |
| 1,448,075 | A | 3/1923 | Melville |
| 1,780,110 | A | 10/1930 | Bliss |
| 1,780,319 | A | 11/1930 | Sonneborn |
| 1,822,871 | A | 9/1931 | Morley |
| 1,881,610 | A | 10/1932 | Hyde |
| 1,951,063 | A | 3/1934 | Reimann et al. |
| 1,979,859 | A | 11/1934 | Brown |
| 1,991,788 | A | 2/1935 | Cartier |
| 2,162,620 | A | 6/1939 | Larsen |
| 2,205,893 | A | 6/1940 | Unger |
| 2,335,687 | A | 11/1943 | Modine |
| 2,365,688 | A | 12/1944 | Dewey |

(Continued)

FOREIGN PATENT DOCUMENTS

| | | | |
|---|---|---|---|
| EP | 0570642 | A1 | 11/1993 |
| GB | 2091868 | A | 8/1982 |

(Continued)

OTHER PUBLICATIONS

International Search Report and Written Opinion in corresponding International Application No. PCT/US2010/054272 filed Oct. 27, 2010 (not prior art).

(Continued)

*Primary Examiner* — Kang Hu
*Assistant Examiner* — John Bargero
(74) *Attorney, Agent, or Firm* — Waddey & Patterson, P.C.; Lucian Wayne Beavers

(57) ABSTRACT

A fire tube heater apparatus includes a shell, with a tube bundle received in the shell and a burner section communicated with the tube bundle. The tubes in the tube bundle have circular inlet and outlet end portions with a flattened, serpentine intermediate portion. The intermediate portion has a width greater than the inlet outside diameter and a tube thickness transverse to the width less than the inlet outside diameter.

16 Claims, 5 Drawing Sheets

(56) References Cited

U.S. PATENT DOCUMENTS

| | | | | |
|---|---|---|---|---|
| 2,466,684 | A | | 4/1949 | Case |
| 2,506,120 | A | * | 5/1950 | Turner ..... 126/90 R |
| 2,653,799 | A | | 9/1953 | Stahn et al. |
| 2,800,126 | A | | 7/1957 | Costello et al. |
| 2,979,050 | A | | 4/1961 | Costello |
| 3,002,519 | A | | 10/1961 | Wright et al. |
| 3,004,330 | A | | 10/1961 | Wilkins et al. |
| 3,177,936 | A | | 4/1965 | Walter |
| 3,196,657 | A | | 7/1965 | Fromson |
| 3,241,609 | A | | 3/1966 | Reznor |
| 3,603,384 | A | * | 9/1971 | Huggins et al. ..... 165/181 |
| 3,698,429 | A | | 10/1972 | Lowe et al. |
| 3,724,523 | A | | 4/1973 | Mattern |
| 3,875,997 | A | | 4/1975 | Newson et al. |
| 3,964,873 | A | | 6/1976 | Aramaki et al. |
| 4,014,962 | A | | 3/1977 | del Notario |
| 4,190,105 | A | | 2/1980 | Dankowski |
| 4,206,806 | A | | 6/1980 | Togashi |
| 4,271,789 | A | | 6/1981 | Black |
| 4,393,926 | A | | 7/1983 | Appel |
| 4,434,112 | A | | 2/1984 | Pollock |
| 4,466,479 | A | | 8/1984 | MacLean |
| 4,678,116 | A | | 7/1987 | Krishnakumar et al. |
| 4,744,505 | A | | 5/1988 | Calleson |
| 4,852,524 | A | | 8/1989 | Cohen |
| 5,024,379 | A | | 6/1991 | Dempsey |
| 5,098,125 | A | * | 3/1992 | Thornton et al. ..... 280/743.1 |
| 5,099,576 | A | * | 3/1992 | Shinmura ..... 29/890.049 |
| 5,186,250 | A | | 2/1993 | Ouchi et al. |
| 5,251,693 | A | | 10/1993 | Zifferer |
| 5,311,661 | A | | 5/1994 | Zifferer |
| 5,409,057 | A | | 4/1995 | Zifferer |
| 5,551,504 | A | | 9/1996 | Zifferer |
| 5,579,832 | A | | 12/1996 | Le Gauyer |
| 5,590,711 | A | | 1/1997 | Ishida et al. |
| 5,644,842 | A | | 7/1997 | Coleman |
| 5,799,621 | A | | 9/1998 | Gordon et al. |
| 5,839,505 | A | | 11/1998 | Ludwig et al. |
| 5,881,681 | A | | 3/1999 | Stuart |
| 5,913,288 | A | | 6/1999 | Mickel et al. |
| 5,915,960 | A | | 6/1999 | Check et al. |
| 5,960,870 | A | | 10/1999 | Takahashi et al. |
| 6,044,803 | A | | 4/2000 | Hamos et al. |
| 6,070,657 | A | | 6/2000 | Kunkel |
| 6,082,993 | A | | 7/2000 | O'Leary et al. |
| 6,273,141 | B1 | | 8/2001 | DeSellem |
| 6,283,159 | B1 | | 9/2001 | Tada |
| 6,488,079 | B2 | | 12/2002 | Zifferer |
| 6,553,946 | B1 | | 4/2003 | Abraham et al. |
| 6,629,523 | B2 | | 10/2003 | Saltzman et al. |
| 6,923,035 | B2 | | 8/2005 | Zifferer et al. |
| 6,941,754 | B2 | | 9/2005 | Aldridge et al. |
| 7,044,123 | B2 | | 5/2006 | Rigamonti |
| 7,188,481 | B2 | | 3/2007 | DeYoe et al. |
| 7,703,705 | B2 | | 4/2010 | Ganzer |
| 7,748,684 | B2 | | 7/2010 | Ito et al. |
| 8,100,381 | B2 | | 1/2012 | Roschke et al. |
| 8,286,594 | B2 | * | 10/2012 | Smelcer ..... 122/13.3 |
| 2003/0005892 | A1 | | 1/2003 | Baese et al. |
| 2003/0010485 | A1 | * | 1/2003 | Goldman et al. ..... 165/183 |
| 2003/0084896 | A1 | * | 5/2003 | Gierula et al. ..... 126/110 R |
| 2005/0081379 | A1 | * | 4/2005 | Askani et al. ..... 29/890.053 |
| 2007/0044787 | A1 | | 3/2007 | Brice |
| 2007/0209788 | A1 | | 9/2007 | Jing et al. |
| 2007/0215225 | A1 | | 9/2007 | Koch et al. |
| 2008/0076079 | A1 | | 3/2008 | Eggebrecht et al. |
| 2011/0083593 | A1 | | 4/2011 | Hunter et al. |
| 2012/0111434 | A1 | | 5/2012 | Cadeau et al. |
| 2012/0132836 | A1 | | 5/2012 | Cadeau et al. |
| 2012/0153200 | A1 | | 6/2012 | Turrin et al. |

FOREIGN PATENT DOCUMENTS

| | | | |
|---|---|---|---|
| JP | 07190484 | A | 7/1995 |
| JP | 2002174420 | A | 6/2002 |
| SE | 518478 | C2 | 10/2002 |
| WO | 9102195 | A1 | 2/1991 |
| WO | 2004097274 | A1 | 11/2004 |
| WO | 2011009793 | A1 | 1/2011 |
| WO | 2012079167 | A1 | 6/2012 |

OTHER PUBLICATIONS

Exhibit A: "Notification of Transmittal of the International Search Report and the Written Opinion of the International Searching Authority, or the Declaration" mailing date Dec. 16, 2009.

* cited by examiner

FIRE TUBE HEATER

BACKGROUND OF THE INVENTION

1. Field of the Invention

The present invention relates generally to apparatus for heating water or the like, and more particularly, to the construction of heat exchange tubes of the type which carry hot combustion gases therethrough for heat exchange with water or the like flowing around the outside of the tube.

2. Description of the Prior Art

Traditionally heat exchangers, particularly condensing fire tube heat exchangers, have utilized a tube bundle made up of a plurality of relatively small diameter cylindrical tubes extending between an inlet tube sheet and an outlet tube sheet. Typically those tubes have been of a diameter in the range of from ½ to ¾ of an inch. This has required the use of a large number of tubes within a tube bundle to achieve the necessary heat exchange between hot combustion gases and the water or other fluid flowing around the tubes. The use of relatively large numbers of relatively small diameter tubes leads to a substantial effort and expense in welding all of the tubes in place within their respective tube sheets.

There is a need for improved designs for the heat exchange tubes for fire tube heat exchangers.

SUMMARY OF THE INVENTION

In one embodiment a fire tube heater apparatus includes a shell, a tube bundle received in the shell and having an inlet tube sheet and an outlet tube sheet, and a plurality of heat exchange tubes extending between the inlet and outlet tube sheets. A burner section is communicated with the inlet tube sheet so that hot gas from the combustion chamber of the burner section enters the heat exchange tubes at the inlet tube sheet. Each of the heat exchange tubes includes a circular inlet end and a circular outlet end. The inlet end has an inlet outside diameter. Each tube includes a flattened intermediate portion having a tube width greater than the inlet outside diameter and having a tube thickness transverse to the width and less than the inlet outside diameter. The flattened intermediate portion includes generally parallel first and second opposed walls spanning the width of the intermediate portion. The first and second opposed walls each include at least one longitudinally extending inwardly protruding rib. The at least one rib of the first wall is opposed to and protrudes toward the at least one rib of the second wall to form at least one pair of opposed ribs separated by a gap so that upon application of external pressure to the tube the at least one pair of opposed ribs may move toward and engage each other to limit deformation of the intermediate portion due to such external pressure.

In another embodiment a fire tube boiler apparatus includes a burner section for providing a heat input of at least 1.5 million BTU. The apparatus includes a tube bundle including a plurality of fire tubes for conducting hot burner gases therethrough from the burner section. The plurality of fire tubes includes between 30 and 60 fire tubes, each tube having a heat transfer capacity in the range of from 25,000 BTU to 50,000 BTU.

In another embodiment a heater tube apparatus includes a cylindrical inlet end portion having an outside diameter and a cylindrical outlet end portion. A serpentine intermediate portion is located between the end portions. The intermediate portion has a width greater than the outside diameter of the inlet portion and has a thickness transverse to the width less than the outside diameter of the inlet portion.

Numerous objects, features and advantages of the present invention will be readily apparent to those skilled in the art upon a reading of the following disclosure when taken in conjunction with the accompanying drawings.

DETAILED DESCRIPTION OF THE INVENTION

Figure 1:
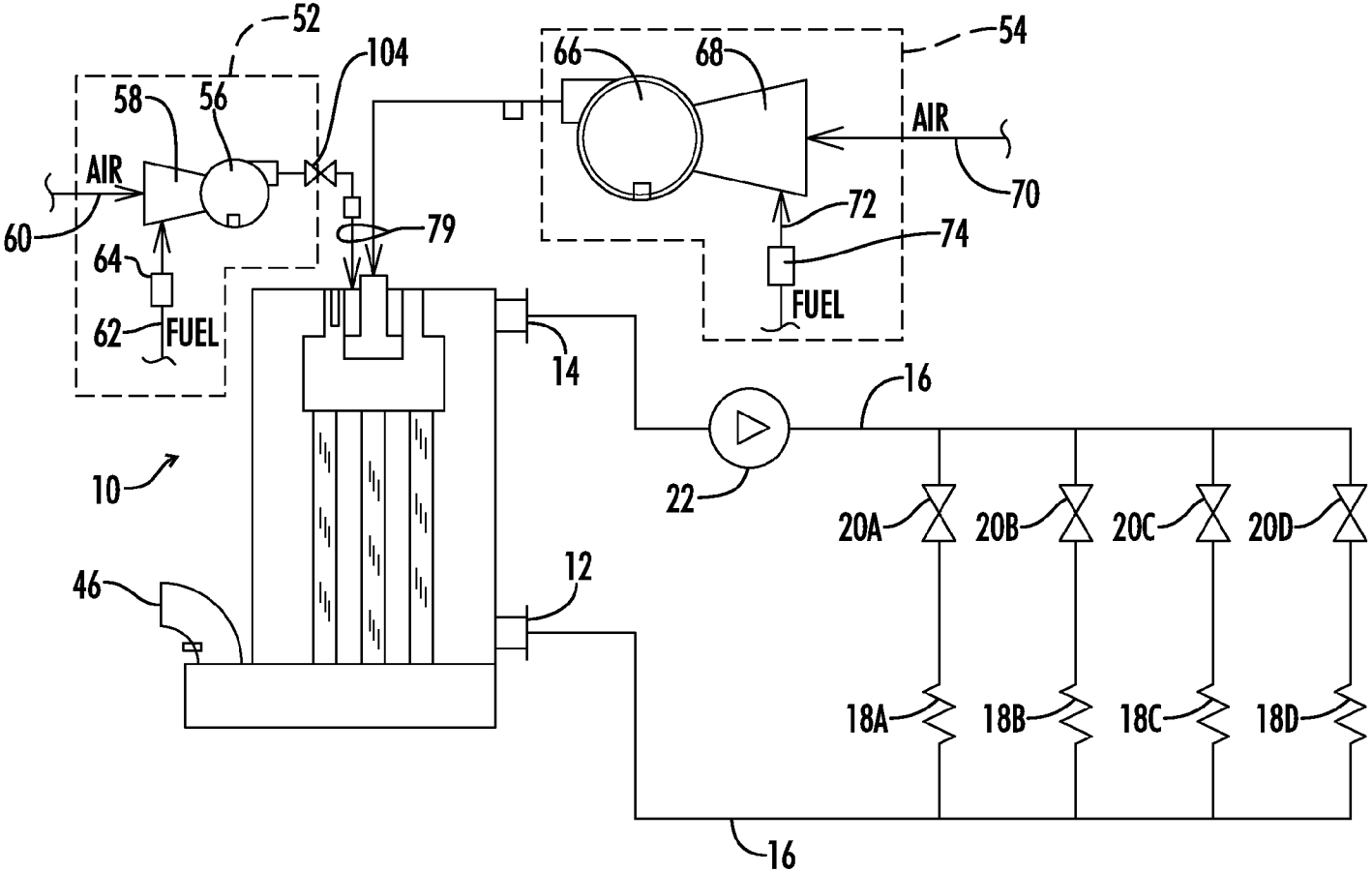
FIG. 1 is a schematic illustration of a water heating apparatus.

Referring now to the drawings, and particularly to FIG. 1, a water heating apparatus is shown and generally designated by the numeral 10. As used herein, the terms water heating apparatus or water heating appliance or water heater apparatus or water heater or boiler all are used interchangeably and all refer to an apparatus for heating water, including both hot water boilers and water heaters that do not actually "boil" the water. Such apparatus are used in a wide variety of commercial and residential applications including potable water systems, space heating systems, pool heaters, process water heaters, and the like. Also, the water being heated can include various additives such as antifreeze or the like.

The water heating apparatus 10 illustrated in FIG. 1 is a fire tube heater. A fire tube heater is one in which the hot combustion gases from the burner flow through the interior of a plurality of tubes. Water which is to be heated flows around the exterior of the tubes.

The water heating apparatus 10 shown in FIG. 1 is shown connected to a heat demand load in a manner sometimes referred to as full flow heating wherein a water inlet 12 and water outlet 14 of the heating apparatus 10 are directly connected to a flow loop 16 which carries the heated water to a plurality of loads 18A, 18B, 18C and 18D. The loads 18A-18D may, for example, represent the various heating loads of heat radiators contained in different areas of a building. Heat to a given area of the building may be turned on or off by controlling zone valves 20A-20D. Thus as a radiator is turned on and off or as the desired heat is regulated in various zones of the building, the water flow permitted to that zone by zone valve 20 will vary, thus providing a varying water flow through the flow loop 16 and a varying heat load on the heating apparatus 10. A supply pump 22 in the flow loop 16 circulates the water through the system. The operating principles of the present invention are, however, also applicable to heating apparatus connected to other types of water supply systems, such as for example a system using a primary flow loop for the heat loads, with the water heating apparatus being in a secondary flow loop so that not all of the water circulating through the system necessarily flows back through the water heater. An example of such a primary and secondary flow loop system is seen in U.S. Patent Application Publication No. 2008/0216771 of Paine et al., filed Mar. 9, 2007 and entitled "Control System for Modulating Water Heater", and assigned to the assignee of the present invention.

The apparatus 10 includes an outer jacket or shell 24. The water inlet 12 and water outlet 14 communicate through the jacket 24 with a water chamber 26 or water side 26 of the heat exchanger. In an upper or primary heat exchanger portion 28, an inner heat exchange wall or inner jacket 30 has a combustion chamber or combustion zone 32 defined therein. The lower end of the combustion chamber 32 is closed by an upper tube sheet 34. A plurality of fire tubes 36 have their upper ends connected to upper tube sheet 34 and their lower ends connected to a lower tube sheet 38. The fire tubes extend through a secondary heat exchanger portion 40 of the heat exchanger apparatus 10. The tube sheets 34 and 38, and tubes 36, comprise a tube bundle 37.

A burner assembly or burner apparatus 42 is located within the combustion chamber 32. The burner assembly 42 burns premixed fuel and air within the combustion chamber 32. The hot gases from the combustion chamber 32 flow down through the fire tubes 36 to an exhaust collector 44 and out an exhaust flue 46. The burner 42 and combustion chamber 32 comprise a burner section 43.

Water from flow loop 16 to be heated flows in the water inlet 12, then around the exterior of the fire tubes 36 and up through a secondary heat exchanger portion 48 of water side 26, and continues up through a primary heat exchanger portion 50 of water side 26, and then out through water outlet 14. It will be appreciated that the interior of the apparatus 10 includes at least one baffle, along with the unique orientation of the tubes as shown for example in FIG. 10, for directing the water flow in such a manner that it generally uniformly flows around all of the fire tubes 36 and through the water chamber 50 of primary heat exchanger 28 between the outer jacket 24 and inner jacket 30. As the water flows upward around the fire tubes 36 of the secondary heat exchanger 40 the water is heated by heat transfer from the hot combustion gases inside of the fire tubes 36 through the walls of the fire tubes 36 into the water flowing around the fire tubes 36. As the heated water continues to flow upward through the water side 50 of primary heat exchanger 28 additional heat is transferred from the combustion chamber 32 through the inner jacket 30 into the water contained in water side 50.

Referring again to FIG. 1, first and second blower assemblies 52 and 54, respectively, are connected to the burner apparatus 42 for supplying premixed fuel and air to the burner assembly 42. Each of the blower assemblies is a variable flow premix blower assembly.

The first blower assembly 52 includes a variable flow blower 56 driven by a variable frequency drive motor. A venturi 58 is provided for mixing combustion air and fuel gas. An air supply duct 60 provides combustion air to the venturi 58. A gas supply line 62 provides fuel gas to the venturi 58. A gas control valve 64 is disposed in supply line 62 for regulating the amount of gas entering the venturi 58. The gas control valve 64 includes an integral shutoff valve. In some embodiments the gas control valve and the venturi may be combined into a single integral unit. The gas control valve is preferably a zero governor modulating gas valve for providing fuel gas to the venturi 58 at a variable gas rate which is proportional to the negative air pressure within the venturi caused by the speed of the blower, hence varying the flow rate entering the venturi 58, in order to maintain a predetermined air to fuel ratio over the flow rate range within which the blower 56 operates. In order to provide the variable input operation of the burner assembly 42, the variable flow blower 56 delivers the premixed combustion air and fuel gas to the burner assembly 42 at a controlled blower flow rate within a first blower flow rate range extending from a first range low end to a first range high end. Thus the first blower assembly 52 has a first turndown ratio at least equal to the first range high end divided by the first range low end.

Similarly, the second blower assembly 54 includes variable speed blower 66, venturi 68, air supply duct 70, gas supply line 72 and gas valve 74. The second blower assembly 54 supplies premixed fuel and air to the burner assembly 42 and has a second flow rate range extending from a second range low end to a second range high end so that the second blower assembly has a second turndown ratio equal to the second range high end divided by the second range low end.

Figure 2:
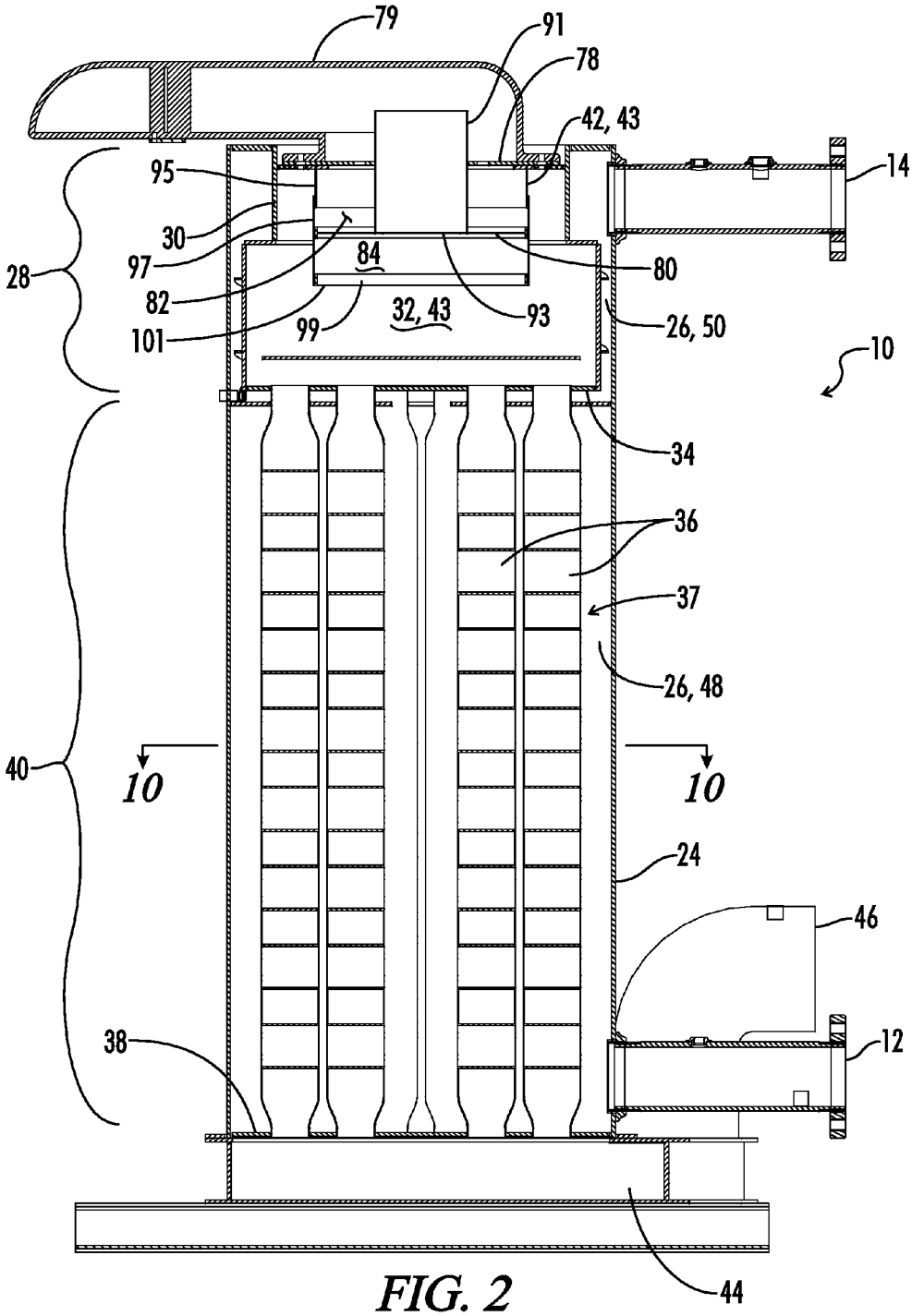
FIG. 2 is a schematic elevation cross-section view of the water heating apparatus of FIG. 1.

Referring now to FIG. 2 the details of construction of the burner assembly 42 are shown. The burner assembly 42 is generally cylindrical in shape and extends into the combustion chamber 32 of the primary heat exchanger section 28. Burner assembly 42 includes a header wall 78 and an interior wall 80 spaced from the header wall 78. The interior wall separates first and second or upper and lower interior zones or plenums 82 and 84.

A blower transition manifold 79 is attached to the header wall 78 and connects the outlets of blower assemblies 52 and 54 to the burner assembly 42. Via manifold 79 the first blower 56 is communicated with first plenum 82, and second blower 66 is communicated with second plenum 84.

A duct 91 extends between divider wall 80 and header wall 78 and extends upward into the manifold 79. Duct 91 is welded or otherwise attached to header wall 78 and divider wall 80. The lower end of duct 91 communicates through opening 93 in divider wall 80 with the second zone 84, and defines a passage communicating second blower 66 with second zone 84.

The burner apparatus 42 further includes an upper collar 95 attached to and extending downward from header wall 78. A perforated cylindrical support screen 97 is attached to collar 95 and divider wall 80. A lower support ring 99 is received in the lower end of support screen 97. A flat lower burner screen 101 is attached to and spans across ring 99. The header wall 78, neck 95, duct 91, divider wall 80, support screen 97, support ring 99, and bottom screen 101 are all preferably constructed of metal and welded together to form a structural skeleton of the burner assembly 42.

A foraminous outer sock is received about the cylindrical screen 97 and bottom screen 101 and held in place by a retaining band. First and second foraminous outer wall portions of the sock are located adjacent the first and second interior zones 82 and 84, respectively.

Additional details of construction of the heater apparatus 10 and particularly of the blowers, intake manifold 79 and control system for the heater apparatus 10, are set forth in U.S. patent application Ser. No. 12/252,841 filed Oct. 16, 2008 by Jim C. Smelcer and entitled "Gas Fired Modulating Water Heating Appliance With Dual Combustion Air Mix Blowers", the details of which are incorporated herein by reference.

The Heat Exchange Tubes

Figure 3:
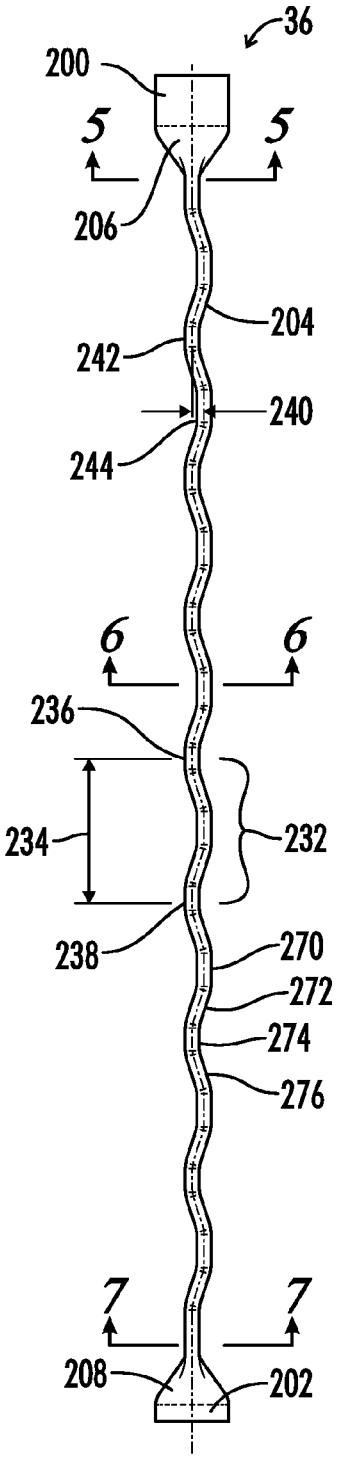
FIG. 3 is an elevation edgewise view of one of the heat exchange tubes of the apparatus of FIG. 2.
Figure 4:
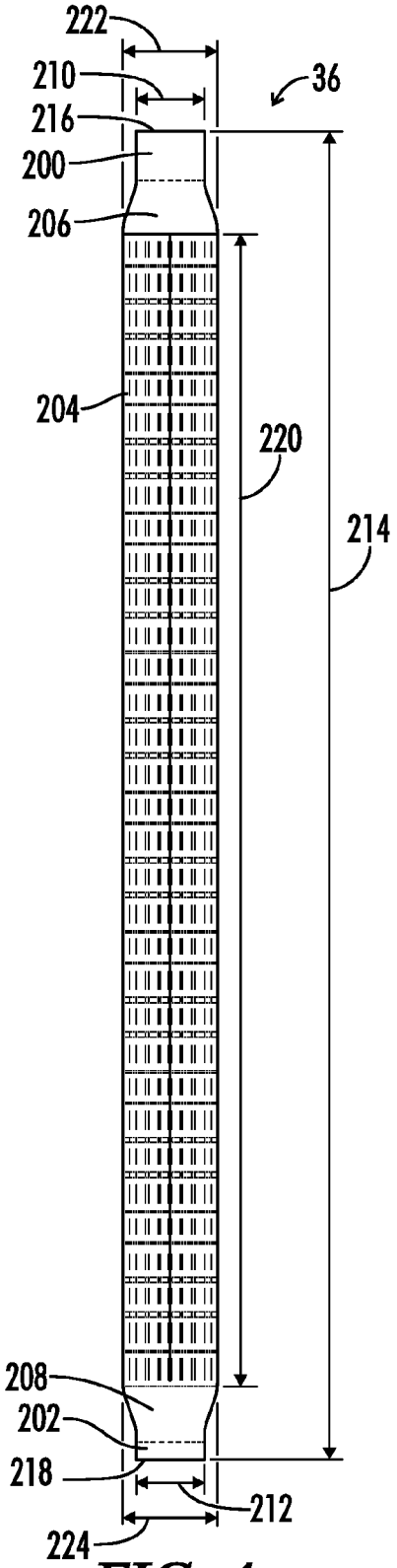
FIG. 4 is a right side elevation view of the tube of FIG. 3 showing the intermediate portion of the tube widthwise.

The details of construction of the heat exchange tubes 36 are best shown in FIGS. 3 and 4. Each of the tubes 36 includes a cylindrical inlet end portion 200, a cylindrical outlet end portion 202, and a serpentine intermediate portion 204 located between the end portions.

The tube 36, as further described below, may be formed from cylindrical round wall tubing stock which is stamped to deform the intermediate portion into the shape as shown. This results in tapered transition portions 206 and 208 which join the inlet and outlet portions 200 and 202, respectively, to the intermediate portion 204. The inlet and outlet portions 200 and 202 have outside diameters 210 and 212, respectively, which may be substantially equal to each other and which may be substantially equal to the outside diameter of the tubing stock from which the heat exchange tube 36 is formed.

The tube has an overall length 214 from its inlet end 216 to its outlet end 218. The serpentine flattened intermediate portion 204 has a length 220. The intermediate portion 204 has an inlet width 222 and an outlet width 224. The width of the intermediate portion 204 may increase from the inlet width 222 to the outlet width 224.

Figure 5:
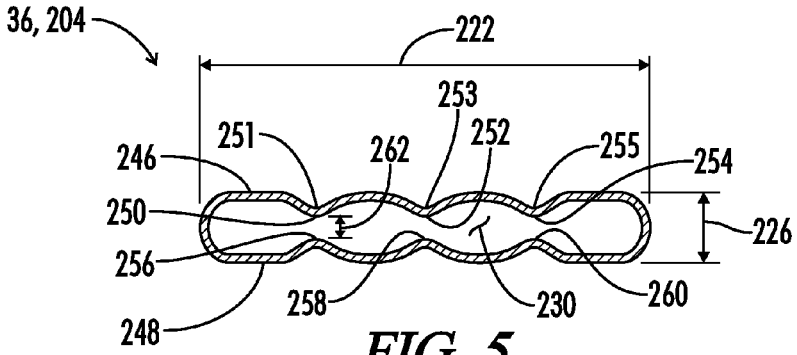
FIG. 5 is a section view taken along line 5-5 of FIG. 3 showing the cross-section of the intermediate portion at its inlet end nearest to the inlet of the tube.
Figure 7:
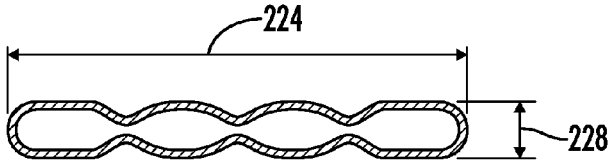
FIG. 7 is a cross-sectional view of the tube of FIG. 3 taken along line 7-7.

The intermediate portion 204 also has a thickness transverse to its width, which thickness may decrease from its inlet thickness 226 shown in FIG. 5 to its outlet thickness 228 shown in FIG. 7.

In general, the intermediate portion 204 can be described as having a width greater than the outside diameter 210 of the cylindrical inlet portion 200 of the tube, and having a thickness transverse to the width less than the outside diameter 210 of the inlet portion of the tube.

The tube 36 may be designed so that the internal cross-sectional area generally shown at 230 in FIG. 5 decreases from the inlet end to the outlet end of the intermediate portion 204. The degree of this decrease in cross-sectional area may be selected so that the flow velocity of hot gases within the tube will remain relatively constant as the gases flow downward through the tube.

As is best appreciated in viewing the edgewise view of FIG. 3, the serpentine intermediate portion 204 includes a plurality of undulations such as 232 which may be conveniently described as having a wavelength 234 extending from a center line of one peak 236 to the center line of the next peak 238. Similarly, each undulation may be described as having a height 240 from one peak 242 to an adjacent trough 244 measured at a center line of the thickness of the intermediate portion.

In one embodiment the wavelength 234 may be in the range of from about 1.0 to about 2.0 times the greatest width 224 of the intermediate portion 204, and the height 240 may be less than a greatest thickness 226 of the intermediate portion 204.

In another embodiment the height 240 may be in the range of from about 0.05 to about 0.20 times the maximum width 244 of the intermediate section.

In one embodiment the peak to trough height 240 may be substantially the same for all of the undulations.

In an embodiment, the wavelength 234 may be substantially the same for all of the undulations, but it need not be for all embodiments.

The undulating shape having dimensions generally like those just described may be described as a gentle undulating shape having relatively shallow gradual curves or directional changes. This shape provides multiple important functions. One purpose of the undulating shape is to cause gradual gentle directional changes for the hot gases flowing therethrough so as to provide improved heat transfer as compared to that which would be achieved with a straight tube. These shallow curves provide enough flow disruption for good heat exchange, but not so much as to cause excessive pressure drop.

Another purpose of the undulating shape is that it allows the tube to flex when subjected to thermal changes which would otherwise cause the tube to attempt to contract or expand its length. This provides a relatively stress free tube construction which does not impose substantial thermal stresses on the locations where the tubes are welded to the tube sheets. Thus lengthwise stresses imposed upon the tube by thermal changes are accommodated by resilient bending of the undulating shape.

Although the undulating shape is generally describable as a series of shallow curves, the shape may be formed by forming a series of generally straight sections which may for example include a repeating series made up of a longitudinally oriented first section 270, an inclined second section 272, a longitudinally oriented third section 274, and an inclined fourth section 276 inclined in a direction oppositely from that of the second section 272.

In an embodiment the tubes 36 are designed with an overall length 214 of no greater than 50 inches in order to provide an overall height of the apparatus 10 which could be utilized in typical boiler rooms of buildings.

In one embodiment the outside diameters 210 and 212 may be in the range of from about 2.0 to about 3.0 inches, and in another embodiment the outside diameters may be approximately 2.5 inches.

In an embodiment the widths 222 and 224 may be generally in the range of from about 3.0 to about 4.0 inches.

In an embodiment the thicknesses such as 226 and 228 may be in the range of from about 0.25 to about 1.0 inch.

Figure 8:
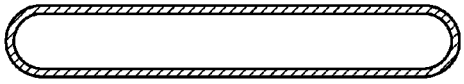
FIG. 8 is a cross-sectional view similar to FIG. 5 but of an alternative version of the tube which does not include the longitudinal ribs.
Figure 9:
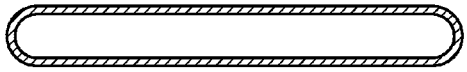
FIG. 9 is a is a cross-sectional view similar to FIG. 7 of the alternative embodiment of FIG. 8 which does not include longitudinal ribs.

In one embodiment such as shown in FIGS. 8 and 9 the cross-sectional shape of the intermediate portion 204 may be generally oval and free from any reinforcing ribs.

In another embodiment, as illustrated in FIGS. 4-7, the intermediate portion 204 may have a plurality of reinforcing ribs formed therein as further described below.

As shown in the cross-sectional view of FIG. 5, the intermediate portion 204 may include first and second opposed walls 246 and 248 spanning the width 222 of the intermediate portion. The first wall 246 includes first, second and third inwardly protruding ribs 250, 252 and 254, formed by external creases 251, 253 and 255. The second wall 248 includes first, second and third ribs 256, 258 and 260 which are opposed to and protrude toward the ribs of the first wall 246 to form three pairs of opposed ribs each of which is separated by a gap 262.

Figure 6:
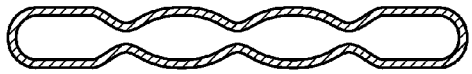
FIG. 6 is a cross-sectional view of the tube of FIG. 3 taken along line 6-6.

As is apparent in viewing FIGS. 6 and 7 and comparing them to FIG. 5, the gap 262 narrows from an inlet end to an outlet end of the intermediate portion 204.

The ribs may serve multiple purposes. One purpose is to provide structural reinforcement to the cross-sectional shape of the intermediate portion 204, so that thinner wall tube materials can be used while providing structural strength equivalent to a thicker wall tube without ribs. As will be appreciated by those skilled in the art, many water heater apparatus such as the apparatus 10 are required to pass tests specified in certain design codes such as for example the ASME boiler code, which requires structures such as the heat exchange tube 36 to pass external pressure tests. These pressure tests may require that upon the application of an external proof test pressure of for example 480 psi the structure does not undergo any substantial permanent deformation.

Figure 5A:
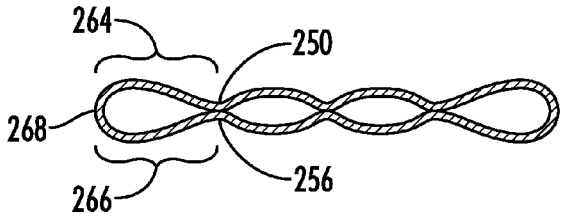
FIG. 5A is a cross-sectional view similar to FIG. 5 showing deflection of the tube under external pressure.

FIG. 5A schematically illustrates the cross-section of FIG. 5 under such pressure testing where external pressures have caused the cross-sectional shape to deform inwardly so that the opposed pairs of ribs contact each other to limit further inward deformation. Upon the release of such external pressure, the resiliency of the cross-sectional shape causes the walls to return to their original position. Particularly the shape of relatively flat portions of the walls 246 and 248 and particularly those outer portions such as 264 and 266 denoted in FIG. 5A which are located between the laterally outermost ribs 250 and 256 and the edge walls such as 268, contribute to this resiliency. The outermost portions 264 and 266 may be described as resilient spring wall portions which provide sufficient resiliency so that upon removal of external pressure on the tube 36 the resilient spring wall portions may restore the tube 36 toward an original position as shown in FIG. 5 wherein the ribs such as 250 and 256 are again separated by the gap 262.

Another purpose of the inwardly protruding ribs is to provide additional flow disruption for improved heat transfer purposes.

In one embodiment, the tube 36 having the longitudinal ribs such as illustrated in FIGS. 4-7 may be constructed from 2.5 inch outside diameter 316/316L or equivalent stainless steel tubing having a wall thickness of at least about 0.06 inch, and more specifically about 0.065 inch.

In the embodiment shown in FIGS. 8 and 9 which is free from the longitudinal ribs, the heat exchange tube may be constructed from a 2.5 inch outside diameter 316/316L or equivalent stainless steel tube having a wall thickness of at least about 0.08 inch, and more specifically about 0.083 inch.

In one embodiment, each of the heat exchange tubes 36 may have a heat exchange capacity in the range of from about 25,000 BTU to about 50,000 BTU, and more particularly in a range of from about 30,000 BTU to about 40,000 BTU and most particularly having a heat exchange capacity of approximately 35,000 BTU. Such heat exchange capacities may be achieved at a tube inlet temperature of approximately 2200° F., a tube outlet temperature range of approximately 200-225° F., and a water exit temperature range of approximately 210-250° F.

An example of a tube 36 having a heat exchange capacity of approximately 35,000 BTU is as follows. The tube may be formed from 2.5 inch diameter 316L stainless steel tubing having a wall thickness of about 0.065 inch. The tube length 214 may be about 49 inches, and the length 220 of the intermediate portion may be about 42.5 inches. The intermediate portion may have a total of eight undulations having wavelength 234 of about 5.1 inches, and having a height 240 of about 0.39 inch. The thickness 226,228 of the intermediate portion may taper from about 0.551 inch to about 0.405 inch. The inlet end width 222 of the intermediate portion may be about 3.485 inches and the outlet end width 224 may be about 3.568 inches.

When such a tube design has been provided, the same dimension tube may be utilized for heat exchangers of different capacities by providing different numbers of tubes in the tube bundle. For example, utilizing a heat exchanger tube 36 having a heat transfer capability of 35,000 BTU, a water heater 10 having a capacity of 1.5 million BTU may include approximately 43 such tubes. Similarly, a heat exchanger having a capacity of 2.0 million BTU may include approximately 57 such tubes. Similarly, a heat exchanger having a capacity of 2.5 million BTU may include approximately 72 such tubes. Similarly, a heat exchanger having a capacity of 3.0 million BTU may include approximately 86 such tubes. Similarly, a heat exchanger having a capacity of 3.5 million BTU may include approximately 100 such tubes.

Figure 10:
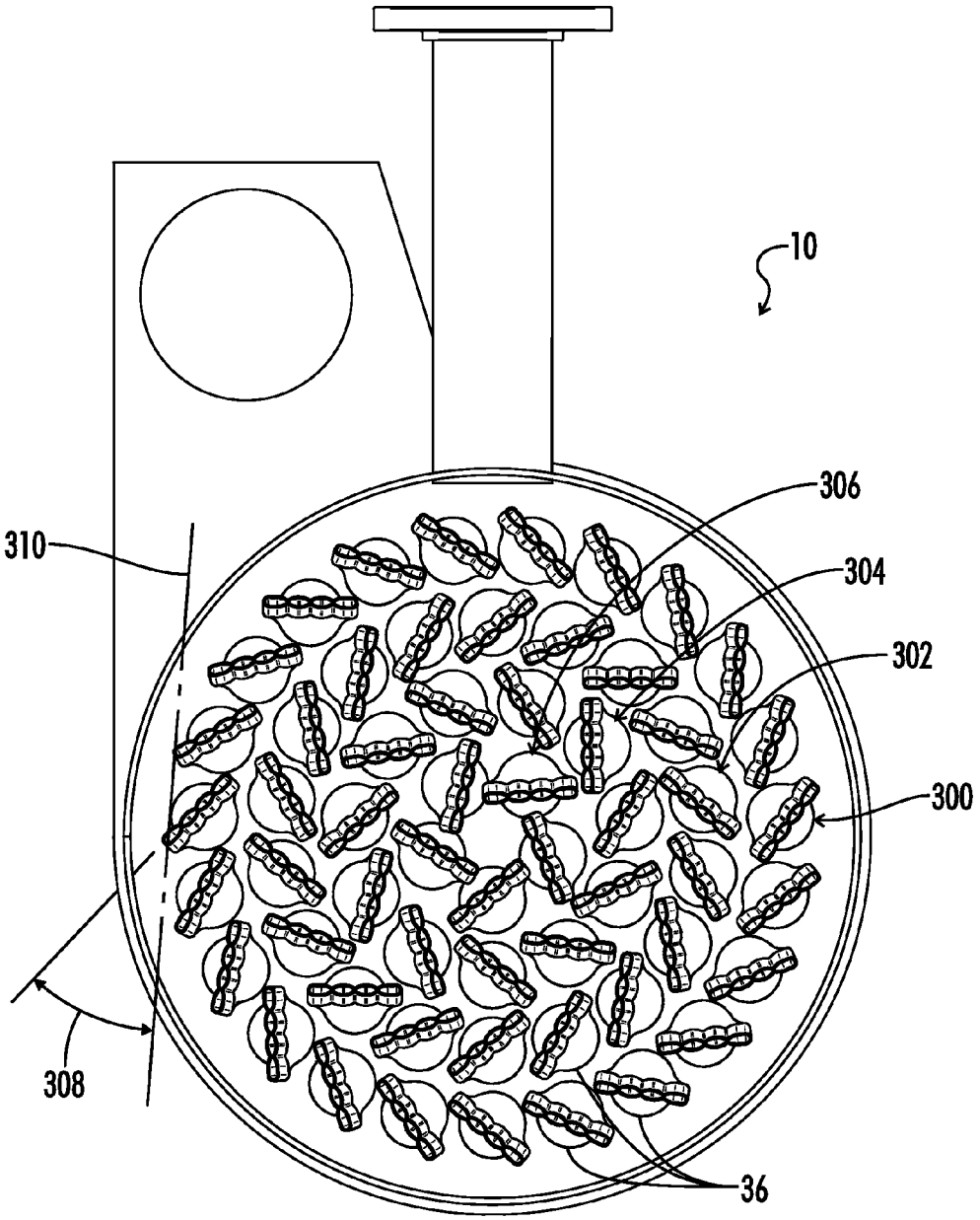
FIG. 10 is a cross-sectional view taken along line 10-10 of FIG. 2 showing the layout of the tubes within the tube bundle.

For example, FIG. 10 shows a cross-section view taken along line 10-10 of FIG. 2 and showing one possible orientation of the tubes 36 for a tube bundle having 57 tubes. The tubes 36 are arranged in a pattern of concentric circles including an outer first circle 300, a second circle 302, a third circle 304, and a fourth circle 306, having 23, 18, 11 and 5 tubes, respectively. The flattened portions 204 of the tubes 36 of the outer first circle 300 may be uniformly inclined at an angle 308 relative to a tangent 310 to the outer first circle 300 adjacent each tube 36 of the outer first circle 300. The angle 308 may be in a range of from about 40 to about 50 degrees, and more specifically may be about 45 degrees. The tubes of the second circle 302 may be inclined oppositely to those of the first circle 300 and at angles 308 approximately the same as those of the first circle 300. Similarly the inclination of the flattened portions of each successive concentrically inner circles such as 304 and 306 may be inclined in alternating directions. This pattern provides an arrangement of the flattened portions of the tubes so that flow in a radially inward direction around the tubes is broken up and made more uniform about all of the tubes. Other tube arrangements may be provided to similar effect.

More generally, for a boiler providing a heat capacity of about 1.5 million BTU, the tube bundle may include between 30 and 60 fire tubes, each tube having a heat transfer capacity in a range of from 25,000 BTU to 50,000 BTU.

The tubes 36 may be formed by liquid impact forming. In a first step a dry cylindrical tube is stamped between two forms to achieve about 75% of the required deformation. Then in a second step the partially formed tube is filled with water and connected to a pressure relief valve to limit internal pressure. The water filled partially formed tube is then stamped between two forms a second time to achieve the final deformation.

Several advantages are provided by the heat exchange tube construction disclosed herein as contrasted to the use of cylindrical heat exchange tubes.

One advantage is that the use of relatively large diameter tubes having an outside diameter of their inlet and outlet ends in the range of from 2 to 3 inches requires much less set up time for welding of tubes to tube sheets as compared to an equivalent capacity heat exchanger utilizing cylindrical tubes having outside diameters of from ½ to ¾ inch.

Another advantage is that due to the much larger flow capacity of these larger diameter tubes, there is significantly less pressure drop through the tubes, and thus much smaller blowers are required for the heater. For example the tube 36 may have a pressure drop of approximately two inches of water, whereas a conventional one-half inch diameter cylindrical fire tube may have a pressure drop in the range of 7 to 10 inches of water.

Also, due to the much larger physical size of the inlet ends of the tubes, the high temperature combustion gases entering those tubes can dissipate their heat much more readily through the ratio of increased surface area of the large tubes in contact with the water backed medium for the intended loading, and thus the inlet ends of the tubes operate at considerably lower operating pressures thus aiding the life of the tubes.

Another advantage of the serpentine tube design is that it accommodates the operation of the heater apparatus 10 in a condensing mode where water vapor from the hot combustion gases condenses into liquid form within the tubes 36. As the hot combustion gases flow downward through the tubes 36 the gases become cooler. At some point, perhaps half way down the length 214 of the tube 36, water vapor may begin to condense on the inside of the tubes. This liquid water must be carried downward through the tubes. In a non-serpentine tube such water vapor will tend to flow in a wicking manner in a film downward along the inside walls of the tube thus significantly decreasing the available flow area for the hot gases and thereby increasing the pressure drop through the tube. Also the presence of a water layer on the inside of a non-serpentine tube may decrease heat transfer from the lower portions of the tube. The serpentine shaped tube 36, on the other hand, causes the condensate to be in more of a dripping state rather than a wicking state, so that the hot combustion gases still engage the interior walls of the lower portions of the tube and the drops of condensate tend to be entrained in the downwardly flowing gases rather than clinging to the walls. The undulations provide alternating flow disruptions extending transverse to the tube length, so that downward flow of condensed water within the tubes is disrupted to reduce wicking flow of water on the inside surfaces of the tube walls. This reduces the pressure drop through the tubes and increases the heat transfer from the lower portions of the tubes as compared to tubes without the undulations provided by the serpentine shape.

Thus it is seen that the apparatus of the present invention readily achieve the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A fire tube heater apparatus, comprising:

a shell; a tube bundle received in the shell and including an inlet tube sheet, an outlet tube sheet, and a plurality of heat exchange tubes extending between the inlet and outlet tube sheets; a burner section communicated with the inlet tube sheet so that hot gas from the burner section enters the heat exchange tubes at the inlet tube sheet; and wherein each of the heat exchange tubes includes: a circular inlet end having an inlet outside diameter; a circular outlet end; a flattened intermediate portion having a tube width greater than the inlet outside diameter and having a tube thickness transverse to the width and less than the inlet outside diameter, the flattened intermediate portion including generally parallel first and second opposed walls spanning the width of the intermediate portion, the first and second opposed walls each including a plurality of elongated inwardly protruding ribs, each rib having a rib length extending transverse to the tube width and the tube thickness, the ribs of the first wall being opposed to and protruding toward the ribs of the second wall to form a plurality of pairs of opposed ribs, each pair of opposed ribs being separated by a gap, so that upon application of external pressure to the tube the opposed ribs may move toward and engage each other to limit deformation of the intermediate portion due to the external pressure.

2. The apparatus of claim 1, wherein:

the first and second opposed walls have a substantially uniform wall thickness, and the walls have external creases therein creating the inwardlym protruding ribs.

3. The apparatus of claim 1, wherein:

each of the first and second walls includes at least three of the ribs, one of the ribs being centrally located at mid-width of the walls, and the at least three ribs being substantially equally spaced from each other.

4. The apparatus of claim 1, wherein:

the flattened intermediate portion of each of the tubes includes edge walls joining the first and second opposed walls, and the portions of the opposed walls between laterally outermost ribs and the edge walls define resilient spring wall portions, so that upon removal of external pressure on the tube the resilient spring wall portions may restore the tube toward an original position with the ribs separated by the gaps.

5. The apparatus of claim 1, wherein:

the intermediate portion of each tube has a length, and has lengthwise edges defining the tube thickness, and as viewed edgewise the intermediate portion has an undulating shape, so that lengthwise stresses imposed upon the tube by thermal changes may be accommodated by resilient bending of the undulating shape.

6. The apparatus of claim 5, wherein the undulating shape comprises a series of substantially equal length undulations having a wavelength greater than the width of the intermediate portion of the tube.

7. The apparatus of claim 6, wherein the wavelength is less than twice the width of the intermediate portion of the tube.

8. The apparatus of claim 5, wherein:

the undulating shape is provided by a repeating series of:

a longitudinally oriented first section;

an inclined second section;

a longitudinally oriented third section; and an inclined fourth section, inclined oppositely from the second section.

9. The apparatus of claim 1, wherein:

the intermediate portion of each tube has an internal cross-sectional flow area which decreases from an inlet end to an outlet end of the intermediate portion.

10. The apparatus of claim 9, wherein:

the gaps separating the pairs of opposed ribs narrow from the inlet end to the outlet end of the intermediate portion.

11. The apparatus of claim 1, wherein:

the inlet and outlet outside diameters are equal to each other and are in the range between two and three inches;

the tube width of the intermediate portion is between three and four inches; and the opposed walls of the tube each have a relatively uniform wall thickness of at least about 0.06 inch.

12. The apparatus of claim 11, wherein the tubes are stainless steel tubes.

13. The apparatus of claim 1, wherein each of the tubes has a heat exchange capacity of at least 30,000 BTU.

14. The apparatus of claim 1, wherein the apparatus has a heat exchange capacity of at least 1.5 million BTU.

15. The apparatus of claim 1, wherein the apparatus has a heat exchange capacity of at least 3.5 million BTU.

16. The apparatus of claim 1, wherein:

each of the tubes has a tube length between the inlet end and the outlet end of no greater than 50 inches.

* * * * *

UNITED STATES PATENT AND TRADEMARK OFFICE

CERTIFICATE OF CORRECTION

PATENT NO. : 8,844,472 B2
APPLICATION NO. : 12/644164
DATED : September 30, 2014
INVENTOR(S) : Smelcer et al.

It is certified that error appears in the above-identified patent and that said Letters Patent is hereby corrected as shown below:

In the Claims

Column 9, line 55, replace “inwardlym” with --inwardly--.

Signed and Sealed this
Twenty-eighth Day of April, 2015

Michelle K. Lee

Michelle K. Lee
*Director of the United States Patent and Trademark Office*